US012667150B2

(12) United States Patent
Yeung

(10) Patent No.: US 12,667,150 B2
(45) Date of Patent: Jun. 30, 2026

(54) WAISTBAND FOR A LOWER TORSO GARMENT

(71) Applicant: LULULEMON ATHLETICA CANADA INC., Vancouver (CA)

(72) Inventor: Lok Lam Yeung, Vancouver (CA)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 395 days.

(21) Appl. No.: 18/322,384

(22) Filed: May 23, 2023

(65) Prior Publication Data

US 2024/0389692 A1 Nov. 28, 2024

(51) Int. Cl.

| | |
|---|---|
| ***A41F 9/00*** | (2006.01) |
| ***A41D 1/06*** | (2006.01) |
| ***A41D 31/12*** | (2019.01) |
| ***A41D 31/18*** | (2019.01) |

(52) U.S. Cl.

CPC ..... *A41F 9/00* (2013.01); *A41D 1/06* (2013.01); *A41D 31/125* (2019.02); *A41D 31/185* (2019.02); *A41D 2500/10* (2013.01); *A41D 2500/20* (2013.01); *A41D 2500/30* (2013.01)

(58) Field of Classification Search

CPC .... A41F 9/00; A41D 1/06; A41D 1/08; A41D 31/125; A41D 31/25001; A41D 2500/20; A41D 2500/30; A41D 2300/332; A41D 2400/38

See application file for complete search history.

(56) References Cited

U.S. PATENT DOCUMENTS

| | | | | |
|---|---|---|---|---|
| 3,711,868 | A * | 1/1973 | Kristof | A41F 9/00 2/237 |
| 4,168,546 | A * | 9/1979 | O'Connor | A41F 9/00 2/220 |
| 5,806,090 | A | 9/1998 | Johnson | |
| 2008/0078012 | A1* | 4/2008 | Mario | A41F 9/02 2/237 |
| 2013/0216810 | A1* | 8/2013 | Hines | A41D 1/02 442/302 |
| 2013/0330992 | A1* | 12/2013 | Mitchell | D06P 3/8223 8/652 |
| 2014/0165265 | A1* | 6/2014 | Tulin | A41D 1/06 2/234 |
| 2014/0208484 | A1* | 7/2014 | Huff | A41F 9/02 2/243.1 |
| 2019/0297976 | A1* | 10/2019 | Peters | A41F 9/02 |
| 2021/0274856 | A1* | 9/2021 | Blythe | A41B 9/14 |
| 2025/0043461 | A1* | 2/2025 | Öztürk | D03D 15/54 |

FOREIGN PATENT DOCUMENTS

| | | |
|---|---|---|
| CN | 109588795 | 4/2019 |

* cited by examiner

*Primary Examiner* — Haley A Smith

(57) ABSTRACT

Examples of an elastic waistband for a lower torso garment are disclosed. The waistband includes a front portion for covering at least a portion of a pelvic area of a wearer, and a back portion for covering at least a portion of a lower back area of the wearer. Each of the front and back portions include an inner fabric layer extending from a top circumferential edge to a bottom circumferential edge of the waistband, an outer fabric layer with a lower edge connected to a lower edge of the inner fabric layer, and an elastic band, with a lower edge of the elastic band connected to the upper edge of the outer fabric layer and an upper edge of the elastic band connected to the upper edge of the inner fabric layer.

20 Claims, 9 Drawing Sheets

WAISTBAND FOR A LOWER TORSO GARMENT

TECHNICAL FIELD

The present disclosure relates to a waistband for a lower torso garment.

BACKGROUND

Waistbands are included as part of many clothing garments to encircle the waist of a wearer and to hold the garment in place against the wearer. Examples of current waistbands for lower torso garments include drawstrings, elastic bands, and fabric bands with varying elasticities and/or stiffness. While there are various types of known waistbands for garments, there are some limitations and disadvantages associated therewith.

For example, many existing waistbands can be felt as either too loose or too tight to the wearer, may roll-over or buckle (particularly during exercise), are rough against the wearer's skin, or create discomfort to the wearer by "digging in" against the abdomen of the wearer.

Thus, there remains a need for waistbands that allow the lower torso garment to be easy to pull on and pull off, and that are smooth and comfortable against the wearer's body.

SUMMARY OF THE APPLICATION

In various embodiments, the present disclosure provides waistbands for a lower torso garment that allow the garment to be pulled on and off easily by a wearer and do not push in against the abdomen of the wearer.

In one aspect, the present disclosure provides a waistband for a lower torso garment, the waistband comprising: a front portion for covering at least a portion of a pelvic area of a wearer, and a back portion for covering at least a portion of a lower back area of the wearer, wherein the front portion and the back portion are connected together along two opposite sides to form a waistband torso opening with a top circumferential edge and a bottom circumferential edge, each of the front portion and the back portion comprising: an inner fabric layer facing a body of the wearer and extending from the top circumferential edge to the bottom circumferential edge, the inner fabric layer have an upper edge and a lower edge; an outer fabric layer having an upper edge and a lower edge, the lower edge connected to the lower edge of the inner fabric layer along the bottom circumferential edge of the waistband; and an elastic band having an upper edge, a lower edge and a width, the lower edge of the elastic band connected to the upper edge of the outer fabric layer and the upper edge of the elastic band connected to the upper edge of the inner fabric layer.

In various embodiments, the upper edge of the inner fabric layer is folded over the top circumferential edge such that the top circumferential edge of the waistband is covered with the inner fabric layer.

In various embodiments, the upper edge of the inner fabric layer is connected to the upper edge of the elastic band along the top circumferential edge of the waistband such that they define the top circumferential edge of the waistband.

In various embodiments, the inner fabric layer is soft, stretchable, moisture absorbent and/or moisture wicking.

In various embodiments, the inner fabric layer comprises two or more zones, each zone having a different module of elasticity.

In various embodiments, the inner fabric layer comprises at least one of a synthetic polymer, a biopolymer, a natural fiber or a combination thereof.

In various embodiments, the inner fabric layer is a woven, an unwoven, or a knitted fabric.

In various embodiments, the outer fabric layer is abrasion resistant, stretchable, moisture absorbent and/or moisture wicking.

In various embodiments, the outer fabric layer comprises at least one of a synthetic polymer, a biopolymer, a natural fiber or a combination thereof.

In various embodiments, the outer fabric layer is a woven, an unwoven or a knitted fabric.

In various embodiments, the waistband further comprises a middle layer positioned between the inner fabric layer and the outer fabric layer, the middle layer having a lower portion aligned with the lower edge of the inner fabric layer and the lower edge of the outer fabric layer, and an upper portion aligned with the upper edge of the outer fabric layer.

In various embodiments, the middle layer may be between a portion of the inner fabric layer and a portion of the outer fabric layer.

In various embodiments, the middle fabric layer may be connected to the outer fabric layer at least along the upper edge of the outer fabric layer.

In various embodiments, the middle layer has a higher level of compressibility than a compressibility level of the inner fabric layer and a compressibility level of the outer fabric layer.

In various embodiments, the middle layer is a mesh.

In various embodiments, the middle layer comprises an adhesive. For example, the adhesive may comprise an adhesive pattern, the adhesive pattern creating two or more zones, each zone having a different module of elasticity.

In various embodiments, an outer face of the elastic band may comprise a designed letter or letters, or a designed graphic or graphics.

In various embodiments, the lower torso garment may be a pair of pants, a pair of tights, a pair of leggings, a pair of shorts, a pair of trousers, a pair of jogging pants, a skort, a skirt, a jumpsuit, a romper or a bodysuit.

In a further aspect, the present disclosure provides an article of lower torso athletic apparel comprising: a first leg portion configured to cover at least a portion of a first leg of a wearer and having a front part and a back part joined together; a second leg portion configured to cover at least a portion of a second leg of the wearer and having a front part and a back part joined together, wherein each of the first and second leg portions have an upper leg opening and a lower leg opening so that each of the wearer's legs passes through the upper and lower leg openings when the article of lower torso athletic apparel is worn by the wearer; a lower torso portion joined with the first leg portion and the second leg portion, the lower torso portion having a front part configured to cover at least a portion of a lower pelvic area of the wearer and a back part configured to cover at least a portion of a lower buttocks area of the wearer; and a waistband joined with the lower torso portion, the waistband comprising a front portion for covering at least a portion of an upper pelvic area of the wearer, and a back portion for covering at least a portion of a lower back area of the wearer, wherein the front portion and the back portion are connected together along two opposite sides to form a waistband torso opening with a top circumferential edge and a bottom circumferential edge, each of the front portion and the back portion comprising: an inner fabric layer facing a body of the wearer and extending from the top circumferential edge to the bottom circumferential edge, the inner fabric layer have an upper edge and a lower edge; an outer fabric layer having an upper edge and a lower edge, the lower edge connected to the lower edge of the inner fabric layer along the bottom circumferential edge of the waistband; and an elastic band having an upper edge, a lower edge and a width, the lower edge of the elastic band connected to the upper edge of the outer fabric layer and the upper edge of the elastic band connected to the upper edge of the inner fabric layer.

In addition to the aspects and embodiments described above, further aspects and embodiments will become apparent by reference to the drawings and study of the following detailed description.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the application. Sizes and relative positions of elements in the drawings are not necessarily drawn to scale. For example, the shapes of various elements and angles may be not drawn to scale, and some of these elements may be arbitrarily enlarged and positioned to improve drawing legibility.

In the accompanying drawings, which illustrate one or more exemplary embodiments.

DETAILED DESCRIPTION

In the following description, details are set forth to provide an understanding of the application. In some instances, certain structures, techniques, and methods have not been described or shown in detail in order not to obscure the application.

In the context of the present disclosure, various terms are used in accordance with what is understood to be the ordinary meaning of those terms.

Directional terms such as "top", "bottom", "front", "back", "upper", "lower", "outer" and "inner" are used in the following description for the purpose of providing relative reference only, and are not intended to suggest any limitations on how any article or garment is to be positioned during use, or to be mounted in an assembly or relative to an environment. The use of the word "a" or "an" when used herein in conjunction with the term "comprising" may mean "one", but it is also consistent with the meaning of "one or more", "at least one" and "one or more than one". Any element expressed in the singular form also encompasses its plural form. Any element expressed in the plural form also encompasses its singular form. The term "plurality" as used herein means more than one, for example, two or more, three or more, four or more, and the like.

The present disclosure relates to a waistband for a lower torso garment. In various embodiments, the disclosure provides waistbands that are easy for a wearer to pull on and pull off, increase support to a body of the wearer, and minimize discomfort by staying positioned on the surface of the wearer's skin and not "digging in" to the torso or abdomen of the wearer. Furthermore, movement and "rolling over" of the waistband during exercise or activity is also minimized. Various logos, graphics, prints or lettering may also be shown on one or more parts or portions of the waistband.

In the context of the present disclosure, the term "seamless" defines a fabric surface that is smooth, and without seams or obvious joins between one part or section and the next.

Figure 1:
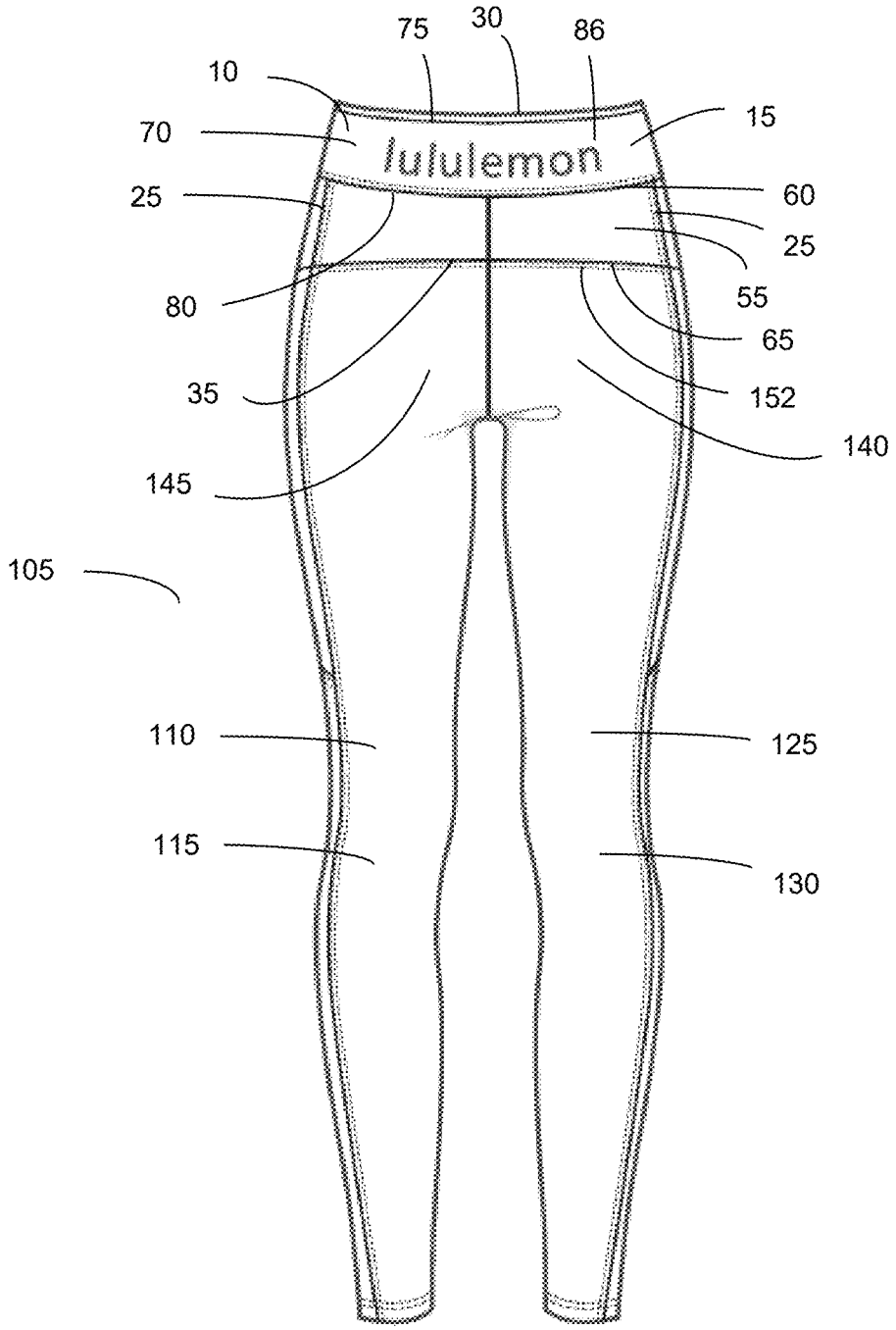
FIG. 1 is a front plan view of a waistband for a lower torso garment in accordance with an embodiment of the invention.
Figure 2:
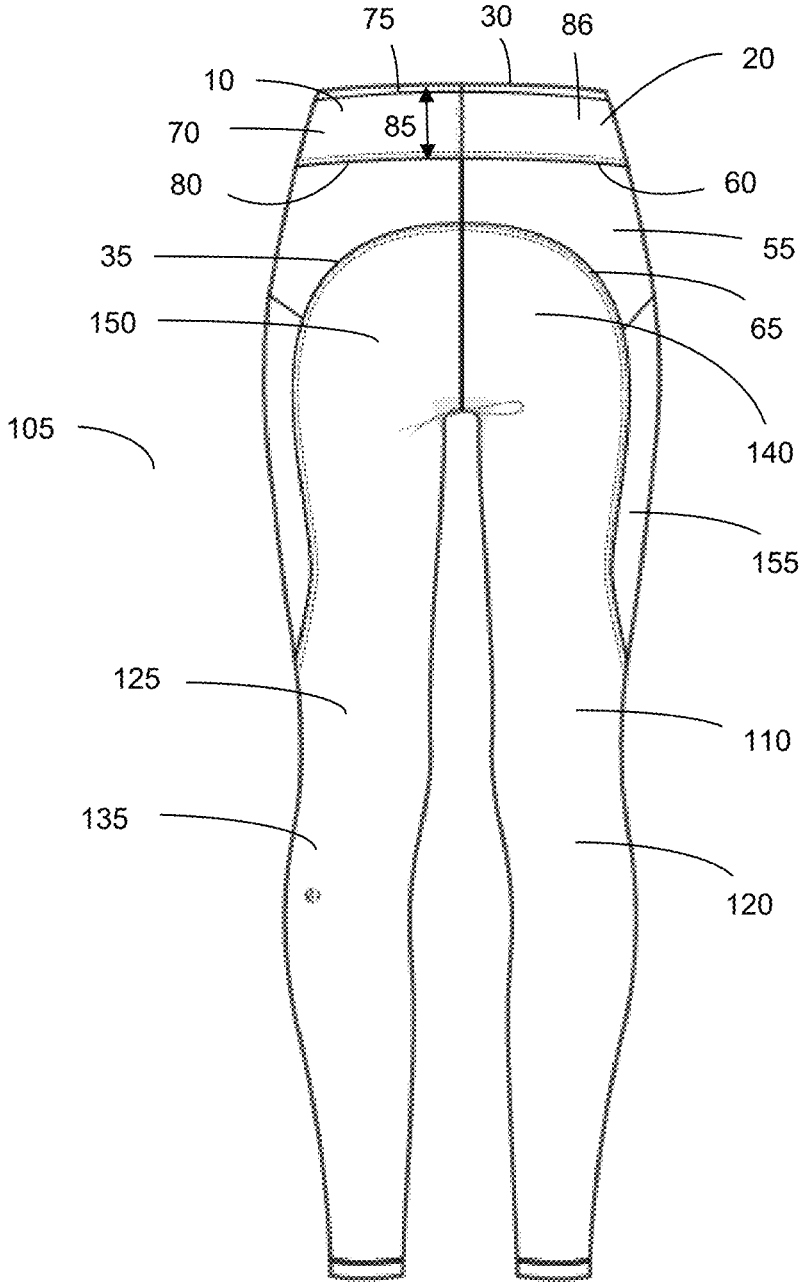
FIG. 2 is a back plan view of a waistband for a lower torso garment in accordance with an embodiment of the invention.
Figure 3:
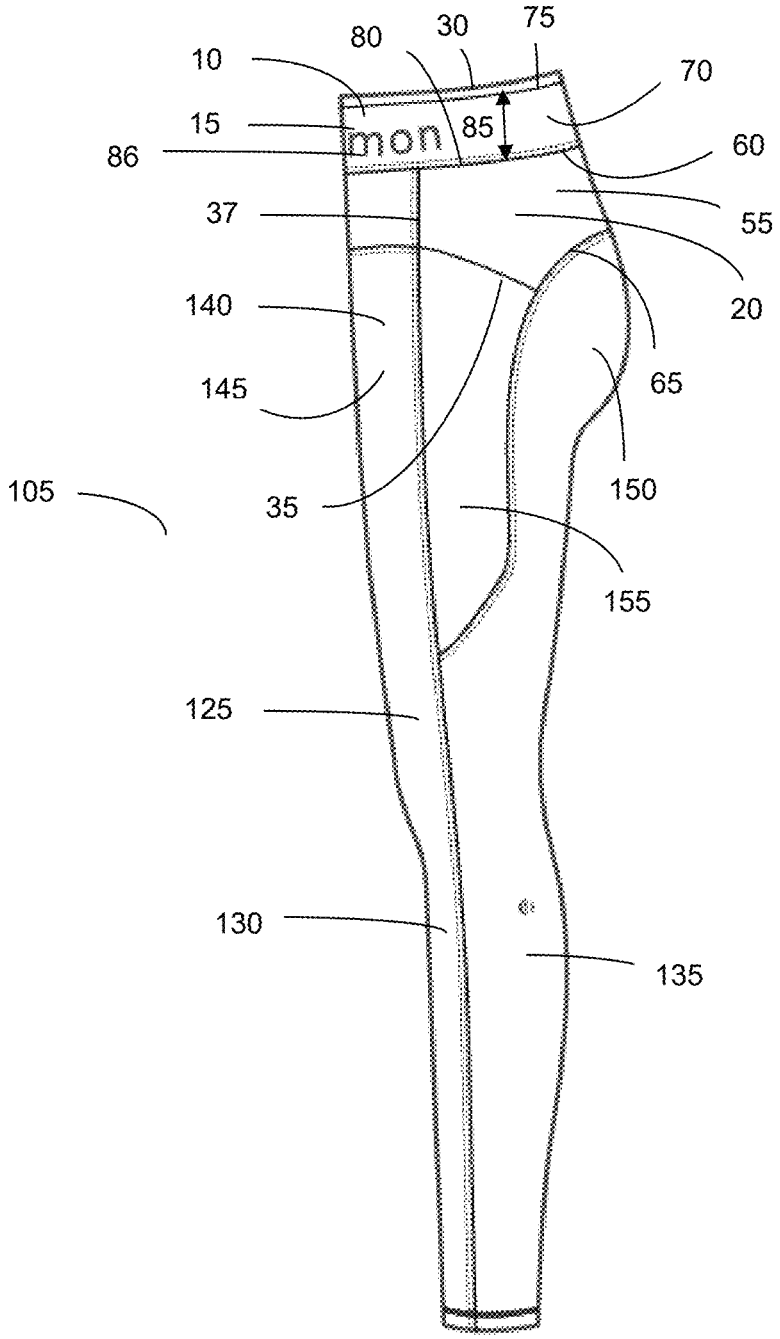
FIG. 3 is a side plan view of a waistband for a lower torso garment in accordance with an embodiment of the invention.
Figure 9:
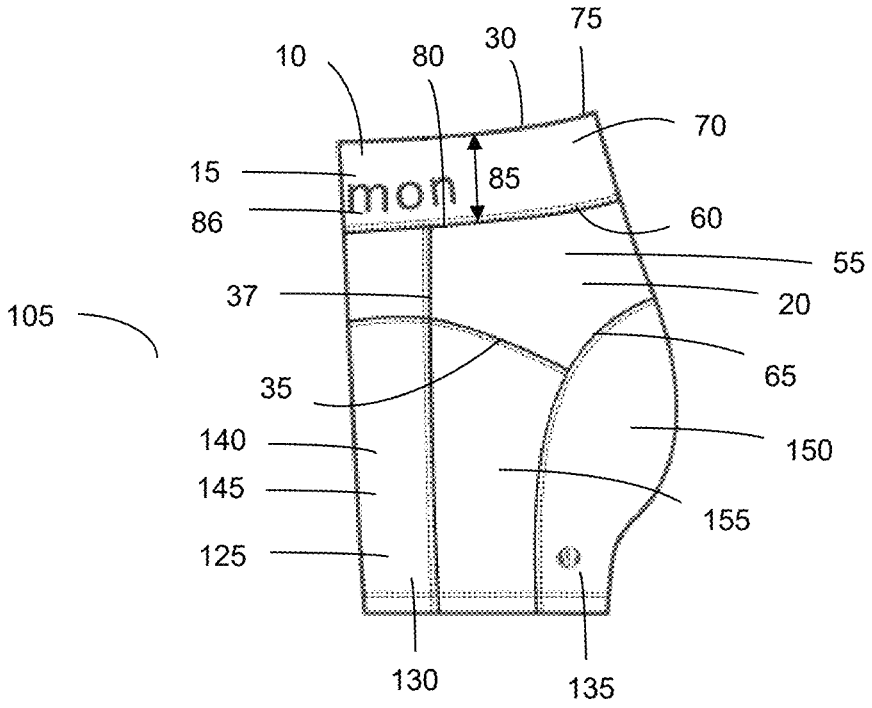
FIG. 9 is a side plan view of a waistband for a lower torso garment in accordance with a further embodiment of the invention.

Referring to FIGS. 1, 2 and 3, and according to a first embodiment of the invention, a waistband 10 for a lower torso garment is shown. The waistband 10 comprises a front portion 15 for covering at least a portion of a pelvic area of a wearer and a back portion 20 for covering at least a portion of a lower back area of the wearer. The front portion 15 and the back portion 20 are connected together along two opposite sides 25 to form a waistband torso opening with a top circumferential edge 30 and a bottom circumferential edge 35. The bottom circumferential edge 35 may be of a variety of shapes, and a shape of the bottom circumferential edge 35 of the front portion 15 may be the same or different from a shape of the bottom circumferential edge 35 of the back portion 20. For example, FIG. 1 shows that the bottom circumferential edge 35 of the front portion 15 is substantially straight, while the bottom circumferential edge 35 of at least a portion of the back portion 20 is an inverted "U-shape". In various embodiments, the connection between the front portion 15 and the back portion 20 is seamless. In various embodiments, a portion of the connection between the front portion 15 and the back portion 20 may be partially seamless and partially include a seam 37, as shown in FIGS. 3 and 9, and discussed in further detail below.

Figure 4:
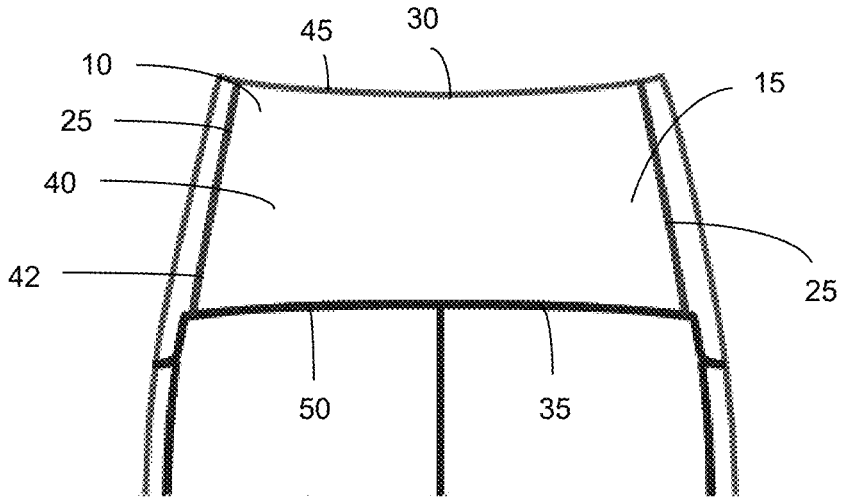
FIG. 4 is a plan view of an interior of a front portion of a waistband for a lower torso garment in accordance with an embodiment of the invention.
Figure 5:
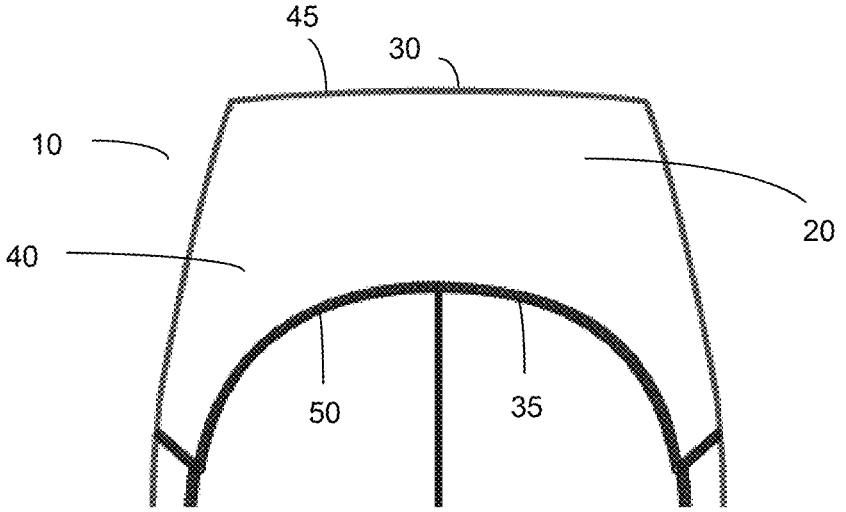
FIG. 5 is a plan view of an interior of a back portion of a waistband for a lower torso garment in accordance with an embodiment of the invention.

In various embodiments, and as shown in FIGS. 4 and 5, each of the front portion 15 and the back portion 20 comprise an inner fabric layer 40 facing a body of the wearer and extending from the top circumferential edge 30 to the bottom circumferential edge 35. The inner fabric layer 40 includes an upper edge 45 and a lower edge 50. The connection between the inner fabric layer 40 of the front portion 15 and the inner fabric layer 40 of the back portion 20 may be seamless. Alternatively, the connection between the inner fabric layer 40 of the front portion 15 and the inner fabric layer 40 of the back portion 20 may comprise a scam 42, as shown, for example, in FIG. 4.

In various embodiments, the inner fabric layer 40 may comprise a soft fabric. In various embodiments, the inner fabric layer 40 may comprise a stretchable fabric. In various embodiments, the inner fabric layer 40 may be moisture absorbent. In various embodiments, the inner fabric layer 40 may be moisture wicking. In various embodiments, the inner fabric layer 40 may be a combination of one or more of a soft fabric, a stretchable fabric, moisture absorbent and/or moisture wicking. For example, the inner fabric layer 40 may be a 4-way stretchable fabric, meaning that the inner fabric layer 40 may stretch in four or more different directions. In one embodiment, for example, the inner fabric layer 40 may have two or more zones, each zone having a different module of elasticity. For example, a zone of the inner fabric layer 40 of the front portion 15 may have a lower module of elasticity (i.e. is more compressive) than the inner fabric layer 40 of the back portion 20 of the waistband 10. In a further embodiment, a zone of the inner fabric layer 40 covering the sides of the wearer's waist and/or hips may have a lower module of elasticity (i.e. is more compressive) than the other zones of the inner fabric layer 40 of the front portion 15 and/or back portion 20 of the waistband 10. In alternative embodiments, one or more zones of the inner fabric layer 40 may comprise a fabric that has 4-way stretchability, one or more zones may comprise a fabric that has 2-way stretchability (i.e. can stretch in two different directions) or one or more zones may comprise fabric that does not stretch or has minimal stretch.

In various embodiments, the inner fabric layer 40 may comprises a synthetic polymer. In various embodiments, the inner fabric layer 40 may comprise a biopolymer. In various embodiments, the inner fabric layer 40 may comprise a natural fiber. In various embodiments, the inner fabric layer 40 may comprise a combination of a synthetic polymer, a biopolymer, and/or a natural fiber. For example, the inner fabric layer 40 may comprise a nylon, a bio-nylon, a polyester, a bio-polyester, a polypropylene, an acrylic, a cotton, silk, wool, modal, micro-modal, viscose rayon, lyocell, cupro, artificial silk, regenerated cellulosic fibers, regenerated protein fibers or a combination thereof. In one embodiment, the inner fabric layer 40 comprises a nylon, a bio-nylon or a combination of a nylon and a bio-nylon, and spandex, for example, Lycra™. In further embodiments, the inner fabric layer 40 may be a composite blend of a synthetic polymer, such as nylon, plaited with an elastane.

In various embodiments, the inner fabric layer 40 comprises a woven fabric. In various embodiments, the inner fabric layer 40 comprises an unwoven fabric. In various embodiments, the inner fabric layer 40 comprises a knitted fabric. In various embodiments, the inner fabric layer 40 may comprise a combination of a woven, an unwoven and/or a knitted fabric.

Each of the front portion 15 and the back portion 20 also comprise an outer fabric layer 55 having an upper edge 60 and a lower edge 65. The lower edge 65 of the outer fabric layer 55 is connected to the lower edge 50 of the inner fabric layer 40 along the bottom circumferential edge 35 of the waistband 10. The connection between the outer fabric layer 55 of the front portion 15 and the outer fabric layer 55 of the back portion 20 may comprise the seam 37 (FIG. 3). Alternatively, the connection between the outer fabric layer 55 of the front portion 15 and the outer fabric layer 55 of the back portion 20 may be seamless.

In various embodiments, the outer fabric layer 55 may comprise an abrasion resistant fabric. In various embodiments, the outer fabric layer 55 may comprise a stretchable fabric. In various embodiments, the outer fabric layer 55 may be moisture absorbent. In various embodiments the outer fabric layer 55 may be moisture wicking. In various embodiments, the outer fabric layer 55 may be a combination of one or more of an abrasion resistant fabric, a stretchable fabric, moisture absorbent and/or moisture wicking. For example, the outer fabric layer 55 may be a 4-way stretchable fabric, meaning that the outer fabric layer 55 may stretch in four or more different directions. In one embodiment, for example, the outer fabric layer 55 may have two or more zones, each zone having a different module of elasticity. For example, a zone of the outer fabric layer 55 of the front portion 15 may have a lower module of elasticity (i.e. is more compressive) than the outer fabric layer 55 of the back portion 20 of the waistband 10. In a further embodiment, a zone of the outer fabric layer 55 covering the sides of the wearer's waist and/or hips may have a lower module of elasticity (i.e. is more compressive) than the other zones of the outer fabric layer 55 of the front portion 15 and/or back portion 20 of the waistband 10. In alternative embodiments, one or more zones of the outer fabric layer 55 may comprise a fabric that has 4-way stretchability, one or more zones may comprise a fabric that has 2-way stretchability (i.e. can stretch in two different directions) or one or more zones may comprise fabric that does not stretch or has minimal stretch.

In various embodiments, the outer fabric layer 55 comprises a synthetic polymer. In various embodiments, the outer fabric layer 55 may comprise a biopolymer. In various embodiments, the outer fabric layer 55 may comprise a natural fiber. In various embodiments, the outer fabric layer 55 may comprise a combination of a synthetic polymer, a biopolymer, and/or a natural fiber. For example, the outer fabric layer 55 may comprise a nylon, a bio-nylon, a polyester, a bio-polyester, a polypropylene, an acrylic, a cotton, silk, wool, modal, micro-modal, viscose rayon, lyocell, cupro, artificial silk, regenerated cellulosic fibers, regenerated protein fibers or a combination thereof. In one embodiment, the outer fabric layer 55 comprises a nylon, a bio-nylon or a combination of a nylon and a bio-nylon, and spandex, for example, Lycra™. In further embodiments, the outer fabric layer 55 may be a composite blend of a synthetic polymer, such as nylon, plaited with an elastane. In one embodiment, the outer fabric layer 55 comprises Cordura™.

In various embodiments, the outer fabric layer 55 comprises a woven fabric. In various embodiments, the outer fabric layer 55 comprises an unwoven fabric. In various embodiments, the outer fabric layer 55 comprises a knitted fabric. In various embodiments, the outer fabric layer 55 may comprise a combination of a woven, an unwoven and/or a knitted fabric.

In various embodiments, the inner fabric layer 40 and the outer fabric layer 55 are different fabrics. Alternatively, the inner fabric layer 40 and the outer fabric layer 55 may be the same fabrics. In further embodiments, one or more zones of the inner fabric layer 40 and one or more zones of the outer fabric layer 55 may be the same fabrics.

Furthermore, each of the front portion 15 and the back portion 20 comprise an elastic band 70 having an upper edge 75, a lower edge 80 and a width 85. The lower edge 80 of the elastic band 70 is connected to the upper edge 60 of the outer fabric layer 55 and the upper edge 75 of the elastic band 70 is connected to the upper edge 45 of the inner fabric layer 40. In various embodiments, the width 85 of the elastic band 70, together with the inner fabric layer 40 that extends from the top circumferential edge 30 to the bottom circumferential edge 35 of the waistband 10, assist in preventing the elastic band 70 from "digging into" or pressing against the abdomen and/or sides of the wearer. As a result, the waistband 10 is snug against the body of the wearer without pushing into the wearer. Furthermore, the width 85 of the elastic band 70 also acts to prevent the elastic band 70 from "rolling over" during exercise and/or activity.

In various embodiments, the width 85 of the elastic band may be approximately the same as a width of the outer fabric layer 55 of the front portion 15.

The elastic band 70 may also comprise a designed letter or letters, or a design graphic or graphics on outer face 86.

Figure 6:
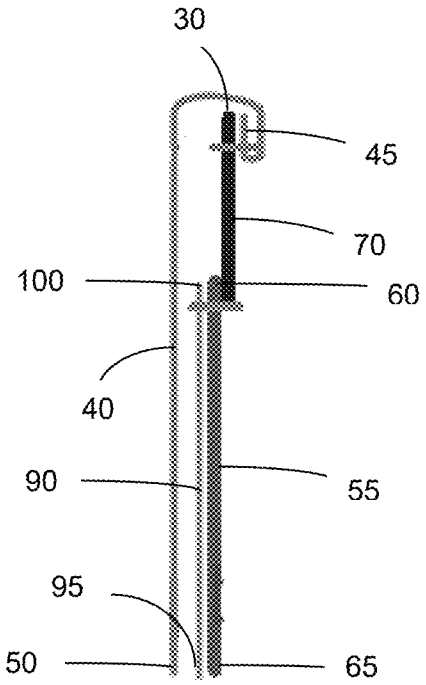
FIG. 6 is an exploded cross-sectional view of a waistband for a lower torso garment in accordance with an embodiment of the invention.
Figure 7:
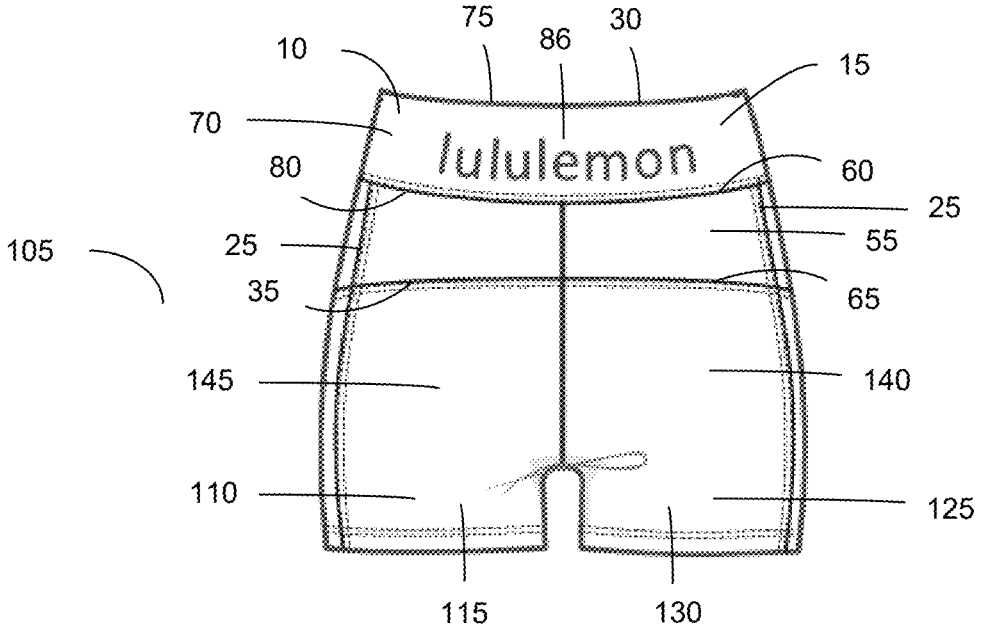
FIG. 7 is a front plan view of a waistband for a lower torso garment in accordance with a further embodiment of the invention.
Figure 8:
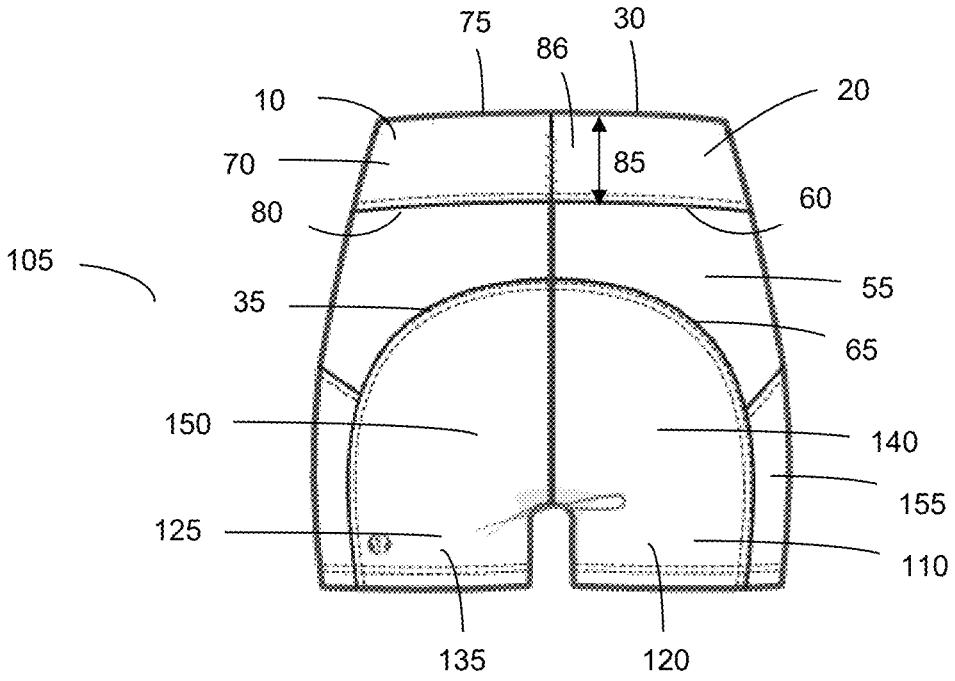
FIG. 8 is a back plan view of a waistband for a lower torso garment in accordance with a further embodiment of the invention.
Figure 10:
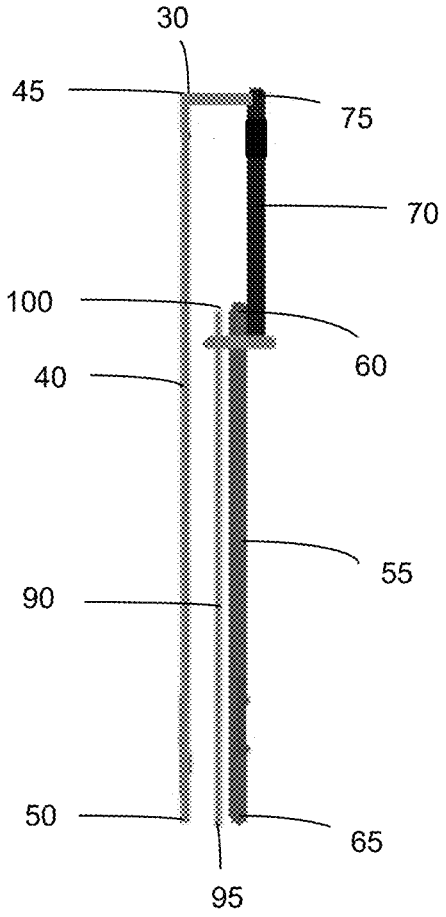
FIG. 10 is an exploded cross-sectional view of a waistband for a lower torso garment in accordance with a further embodiment of the invention.

The top circumferential edge 30 of the waistband 10 may have different finishes. For example, and as shown in FIG. 6, the upper edge 45 of the inner fabric layer 40 may be folded over the top circumferential edge 30 such that the top circumferential edge 30 of the waistband 10 is covered with the inner fabric layer 40. This embodiment of the waistband 10 is also shown in FIGS. 1-3. Alternatively, and as shown in FIG. 10, the upper edge 45 of the inner fabric layer 40 is connected to the upper edge 75 of the elastic band 70 along the top circumferential edge 30 of the waistband 10 such that the inner fabric layer 40 and the elastic band 70 define the top circumferential edge 30 of the waistband 10. This embodiment of the waistband 10 is also shown in FIGS. 7-9.

In various embodiments, and as shown in FIGS. 6 and 10, the waistband 10 may further comprise a middle layer 90 positioned between the inner fabric layer 40 and the outer fabric layer 55. The middle layer 90 comprises a lower portion 95 aligned with the lower edge 50 of the inner fabric layer 40 and the lower edge 65 of the outer fabric layer 55, and an upper portion 100 aligned with the upper edge 60 of the outer fabric layer 55. In various embodiments, the middle layer 90 may be between a portion of the inner fabric layer 40 and a portion of the outer fabric layer 55. In alternative embodiments, the middle layer 90 may be between a portion of the inner fabric layer 40 and an entirety of the outer fabric layer 55. In other words, the middle layer 90 is sized and shaped so as to mirror the size and shape of the outer fabric layer 55 at the front portion 15 of the waistband 10. In various embodiments, the middle layer may comprise a mesh. The middle layer 90 may serve to further increase comfort of the waistband 10 against the body of the wearer by increasing the "softness" of the waistband, providing greater support to and/or compression against the body of the wearer, increasing structural integrity of the waistband 10, and/or modulating moisture control properties of the waistband 10.

In various embodiments, the middle layer 90 may be connected to the outer fabric layer 55 at least along the upper edge 60 of the outer fabric layer 55. In addition, the middle layer 90 may be connected to the lower edge 65 of the outer fabric layer 50 and/or the lower edge 50 of the inner fabric layer 40. In various embodiments, the middle layer 90 may comprise an adhesive such that the middle layer 90 is connected to the outer fabric layer 55 with the adhesive. In various embodiments, the middle layer 90 may be a patterned adhesive layer connected to the outer fabric layer 55 and/or the inner fabric layer 40. For example, the patterned adhesive layer may be a mesh pattern adhesive layer. In one embodiment, the patterned adhesive layer may be formed by a pattern of adhesive (such as, for example, dots, lines, curves, etc.) applied to the outer fabric layer 55 or sandwiched between the outer fabric layer 55 and the inner fabric layer 40. The adhesive pattern may be applied by, for example, printing. The level of compressibility provided by the middle layer 90 may be constant by having a uniform adhesive pattern throughout the middle layer 90, or can vary throughout the middle layer 90. For example, the adhesive pattern may have zones where the size of the adhesive (for example, the size of the dots) in the pattern is smaller and/or the distance between dots is greater, thereby providing a lower compression level, and zones where the size of the adhesive (for example, the size of the dots) in the pattern is larger and/or the distance between dots is less, thereby providing a higher compression level.

In various embodiments, the middle layer 90 may have a higher level of compressibility than a compressibility level of the inner fabric layer 40 and/or a compressibility level of the outer fabric layer 50.

Figure 11:
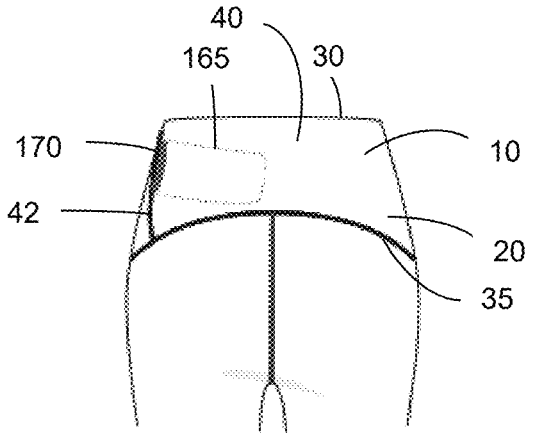
FIG. 11 is a back plan inside view of a waistband for a lower torso garment with an inside pocket in accordance with an additional embodiment of the invention.
Figure 12:
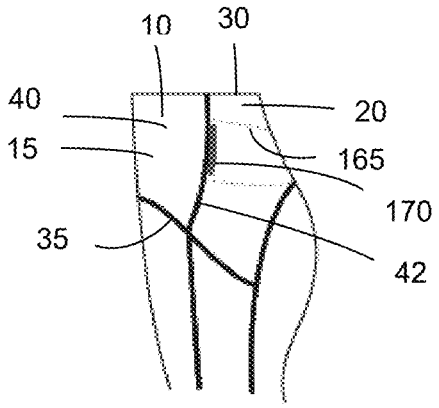
FIG. 12 is a side plan inside view of a waistband for a lower torso garment with an inside pocket in accordance with an additional embodiment of the invention.

In various embodiments, the waistband 10 may also include one or more pockets. For example, and as shown in FIGS. 11 and 12, the back portion 20 of the waistband 10 may comprise an inside pocket bag 165. The pocket bag 165 may be connected to the inner fabric layer 40, between the inner fabric layer 40 and the outer fabric layer 55. An entrance opening 170 of the pocket bag 165 may be along a portion of the seam 42 on an inside surface facing the body of the wearer. Alternatively, the entrance opening 170 may be along a portion of the upper edge 45 of the inner fabric layer 40 of the back portion 20.

The present disclosure also provides a variety of lower torso garments including a waistband as described herein. For example, the lower torso garment may be a pair of pants (as shown in FIGS. 1-3), a pair of tights, a pair of leggings, a pair of shorts (as shown in FIGS. 7-9), a pair of trousers, a pair of jogging pants, a skort, a skirt, a jumpsuit, a romper or a bodysuit.

Figure 13:
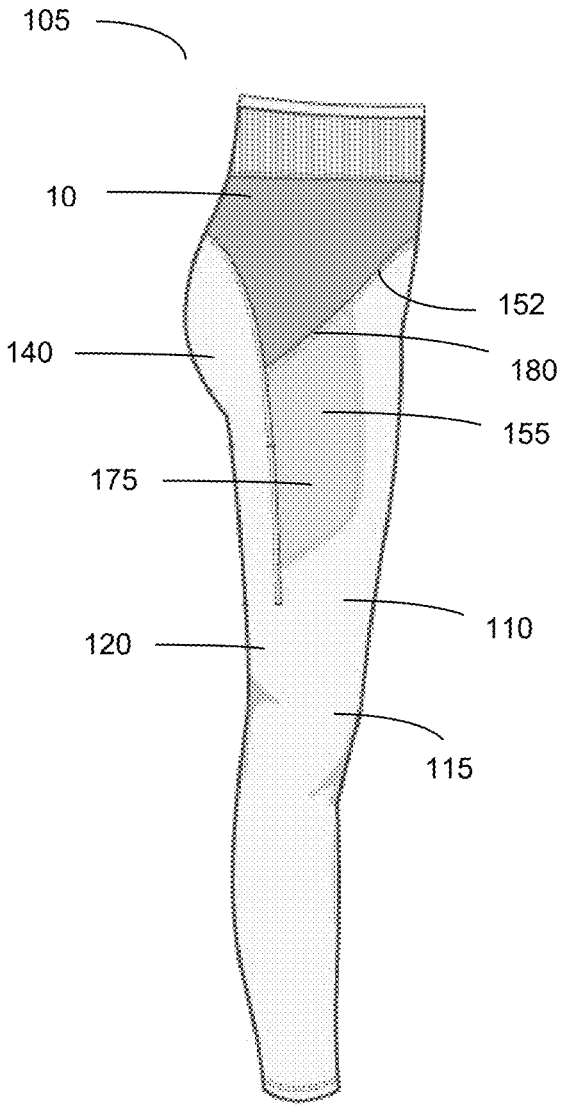
FIG. 13 is a side plan view of an article of lower torso athletic apparel including a waistband in accordance with an embodiment of the invention.

Thus, and with reference to FIGS. 1-3, the present disclosure also provides an article of lower torso athletic apparel 105 comprising a first leg portion 110 configured to cover at least a portion of a first leg of a wearer and having a front part 115 and a back part 120 joined together; and a second leg portion 125 configured to cover at least a portion of a second leg of the wearer and having a front part 130 and a back part 135 joined together. Each of the first and second leg portions, 110 and 125, respectively, have an upper leg opening and a lower leg opening so that each of the wearer's legs passes through the upper and lower leg openings when the article of lower torso athletic apparel 105 is worn by the wearer. The article of lower torso athletic apparel 105 also includes a lower torso portion 140 joined with the first leg portion 110 and the second leg portion 125, the lower torso portion having a front part 145 configured to cover at least a portion of a lower pelvic area of the wearer and a back part 150 configured to cover at least a portion of a lower buttocks area of the wearer. The connection between the lower torso portion 140 and the first and second leg portions, 110 and 125, respectively, may be seamless (as shown in FIGS. 1-3) or comprise a seam. A waistband 10 as described herein is then joined with the lower torso portion 140. The connection between the waistband 10 and the lower torso portion 140 may comprise a scam 152 (as shown in FIG. 13) or be seamless. In various embodiments, the article of lower torso athletic apparel 105 may also comprise one or more panels, such as side panels 155 as shown in FIGS. 2 and 3. In various embodiments, and as shown in FIG. 13, the side panels 155 may comprise a side panel pocket bag 175 defined by: (i) the side panel 155 and the lower torso portion 140, (ii) the side panel 155, the lower torso portion 140 and the first leg portion 110, or (iii) the side panel 155, the lower torso portion 140 and the second leg portion 125. An entrance opening 180 to the side panel pocket bag 175 may be positioned along a portion of the seam 152 between the lower torso portion 140 and the waistband 10, as shown in FIG. 13.

While particular elements, embodiments and applications of the present application have been shown and described, it will be understood, that the scope of the application is not limited thereto, since modifications can be made by those skilled in the art without departing from the scope of the present application, particularly in light of the foregoing teachings. Thus, for example, in any method or process disclosed herein, the acts or operations making up the method/process may be performed in any suitable sequence and are not necessarily limited to any particular disclosed sequence. Elements and components can be configured or arranged differently, combined, and/or eliminated in various embodiments. The various features and processes described above may be used independently of one another, or may be combined in various ways. All possible combinations and subcombinations are intended to fall within the scope of this application. Reference throughout this disclosure to "some embodiments," "an embodiment," or the like, means that a particular feature, structure, step, process, or characteristic described in connection with the embodiment is included in at least one embodiment. Thus, appearances of the phrases "in some embodiments," "in an embodiment," or the like, throughout this disclosure are not necessarily all referring to the same embodiment and may refer to one or more of the same or different embodiments. Indeed, the novel methods and systems described herein may be embodied in a variety of other forms; furthermore, various omissions, additions, substitutions, equivalents, rearrangements, and changes in the form of the embodiments described herein may be made without departing from the spirit of the application.

Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without operator input or prompting, whether these features, elements and/or steps are included or are to be performed in any particular embodiment. No single feature or group of features is required for or indispensable to any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The example calculations, simulations, results, graphs, values, and parameters of the embodiments described herein are intended to illustrate and not to limit the disclosed embodiments. Other embodiments can be configured and/or operated differently than the illustrative examples described herein.

What is claimed is:

1. A waistband for a lower torso garment, the waistband comprising:

a front portion configured for covering at least a portion of a pelvic area of a wearer, and a back portion configured for covering at least a portion of a lower back area of the wearer, wherein the front portion and the back portion are connected together along two opposite sides to form a waistband torso opening with a top circumferential edge and a bottom circumferential edge, each of the front portion and the back portion comprising:

an inner fabric layer extending from the top circumferential edge to the bottom circumferential edge, the inner fabric layer having an upper edge and a lower edge, the inner fabric layer forming an inside surface of the waistband, the inside surface being configured for facing a body of the wearer;

an outer fabric layer having an upper edge and a lower edge, the lower edge connected to the lower edge of the inner fabric layer along the bottom circumferential edge of the waistband, the outer fabric layer forming a first portion of an outside surface of the waistband, the outside surface being configured for facing away from the body of the wearer;

an elastic band having an upper edge, a lower edge and a width, the lower edge of the elastic band connected to the upper edge of the outer fabric layer and the upper edge of the elastic band connected to the upper edge of the inner fabric layer, the elastic band including an exposed portion between the upper edge of the outer fabric layer and the upper edge of the inner fabric layer, the exposed portion of the elastic band forming a second portion of the outside surface of the waistband; and the bottom circumferential edge of the front portion is straight, and the bottom circumferential edge of the back portion has an inverted "U" shape.

2. The waistband of claim 1, wherein the upper edge of the inner fabric layer is folded over the top circumferential edge such that the top circumferential edge of the waistband is covered with the inner fabric layer.

3. The waistband of claim 1, wherein the upper edge of the inner fabric layer is connected to the upper edge of the elastic band along the top circumferential edge of the waistband such that the upper edge of the inner fabric layer and the upper edge of the elastic band define the top circumferential edge of the waistband.

4. The waistband of claim 1, wherein the inner fabric layer comprises two or more zones, each zone having a different module of elasticity.

5. The waistband of claim 1, further comprising a middle layer positioned between the inner fabric layer and the outer fabric layer.

6. The waistband of claim 5, wherein the middle layer has a lower portion aligned with the lower edge of the inner fabric layer and the lower edge of the outer fabric layer, and an upper portion aligned with the upper edge of the outer fabric layer.

7. The waistband of claim 5, wherein the middle layer is connected to the outer fabric layer at least along the upper edge of the outer fabric layer.

8. The waistband of claim 5, wherein the middle layer is a mesh.

9. The waistband of claim 5, wherein the middle layer comprises an adhesive.

10. The waistband of claim 9, wherein the adhesive comprises an adhesive pattern, the adhesive pattern creating two or more zones, each zone having a different module of elasticity.

11. The waistband of claim 1, wherein an outer face of the elastic band comprises a designed letter or letters, or a designed graphic or graphics.

12. The waistband of claim 1, wherein the lower torso garment is a pair of pants, a pair of tights, a pair of leggings, a pair of shorts, a pair of trousers, a pair of jogging pants, a skort, a skirt, a jumpsuit, a romper or a bodysuit.

13. The waistband of claim 1, wherein the inner fabric layer comprises a four-way stretchable fabric.

14. The waistband of claim 1, wherein a shape of the bottom circumferential edge of the front portion is different than a shape of the bottom circumferential edge of the back portion.

15. The waistband of claim 1, wherein the back portion of the waistband comprises an inside pocket bag.

16. The waistband of claim 15, wherein the inside pocket bag is connected to the inner fabric layer and is positioned between the inner fabric layer and the outer fabric layer.

17. The waistband of claim 15, wherein an entrance opening of the inside pocket bag is along a portion of one of the two opposite sides forming the waistband torso opening; optionally wherein the entrance opening is on the inside surface of the waistband.

18. The waistband of claim 1, wherein a lower edge of the elastic band overlaps the upper edge of the outer fabric layer, and the upper edge of the outer fabric layer is positioned between the inner fabric layer and the elastic band.

19. An article of lower torso athletic apparel comprising:

a first leg portion configured to cover at least a portion of a first leg of a wearer and having a front part and a back part joined together;

a second leg portion configured to cover at least a portion of a second leg of the wearer and having a front part and a back part joined together, wherein each of the first and second leg portions have an upper leg opening and a lower leg opening configured to allow each of the wearer's legs to pass through the upper and lower leg openings when the article of lower torso athletic apparel is worn by the wearer;

a lower torso portion joined with the first leg portion and the second leg portion, the lower torso portion having a front part configured to cover at least a portion of a lower pelvic area of the wearer and a back part configured to cover at least a portion of a lower buttocks area of the wearer; and a waistband joined with the lower torso portion, the waistband comprising a front portion configured for covering at least a portion of an upper pelvic area of the wearer, and a back portion for covering at least a portion of a lower back area of the wearer, wherein the front portion and the back portion are connected together along two opposite sides to form a waistband torso opening with a top circumferential edge and a bottom circumferential edge, each of the front portion and the back portion comprising:

an inner fabric layer extending from the top circumferential edge to the bottom circumferential edge, the inner fabric layer having an upper edge and a lower edge, the inner fabric layer forming an inside surface of the waistband, the inside surface being configured for facing a body of the wearer;

an outer fabric layer having an upper edge and a lower edge, the lower edge connected to the lower edge of the inner fabric layer along the bottom circumferential edge of the waistband, the outer fabric layer forming a first portion of an outside surface of the waistband, the outside surface being configured for facing away from the body of the wearer;

an elastic band having an upper edge, a lower edge and a width, the lower edge of the elastic band connected to the upper edge of the outer fabric layer and the upper edge of the elastic band connected to the upper edge of the inner fabric layer, the elastic band including an exposed portion between the upper edge of the outer fabric layer and the upper edge of the inner fabric layer, the exposed portion of the elastic band forming a second portion of the outside surface of the waistband; and wherein the bottom circumferential edge of the front portion is straight, and the bottom circumferential edge of the back portion has an inverted "U" shape, or wherein the back portion of the waistband comprises an inside pocket bag, or wherein a lower edge of the elastic band overlaps the upper edge of the outer fabric layer, and the upper edge of the outer fabric layer is positioned between the inner fabric layer and the elastic band.

20. A waistband for a lower torso garment, the waistband comprising:

a front portion configured for covering at least a portion of a pelvic area of a wearer, and a back portion configured for covering at least a portion of a lower back area of the wearer, wherein the front portion and the back portion are connected together along two opposite sides to form a waistband torso opening with a top circumferential edge and a bottom circumferential edge, each of the front portion and the back portion comprising:

an inner fabric layer extending from the top circumferential edge to the bottom circumferential edge, the inner fabric layer having an upper edge and a lower edge, the inner fabric layer forming an inside surface of the waistband, the inside surface being configured for facing a body of the wearer;

an outer fabric layer having an upper edge and a lower edge, the lower edge connected to the lower edge of the inner fabric layer along the bottom circumferential edge of the waistband, the outer fabric layer forming a first portion of an outside surface of the waistband, the outside surface being configured for facing away from the body of the wearer;

an elastic band having an upper edge, a lower edge and a width, the lower edge of the elastic band connected to the upper edge of the outer fabric layer and the upper edge of the elastic band connected to the upper edge of the inner fabric layer, the elastic band including an exposed portion between the upper edge of the outer fabric layer and the upper edge of the inner fabric layer, the exposed portion of the elastic band forming a second portion of the outside surface of the waistband; and a lower edge of the elastic band overlaps the upper edge of the outer fabric layer, and the upper edge of the outer fabric layer is positioned between the inner fabric layer and the elastic band.

* * * * *